US008061331B2

(12) United States Patent
Tsukada et al.

(10) Patent No.: US 8,061,331 B2
(45) Date of Patent: Nov. 22, 2011

(54) FUEL INJECTOR FOR INTERNAL COMBUSTION ENGINE

(75) Inventors: Shinsaku Tsukada, Mito (JP); Hideharu Ehara, Yokohama (JP); Takashi Okamoto, Novi, MI (US)

(73) Assignee: Hitachi, Ltd., Tokyo (JP)

( * ) Notice: Subject to any disclaimer, the term of this patent is extended or adjusted under 35 U.S.C. 154(b) by 304 days.

(21) Appl. No.: 12/361,951

(22) Filed: Jan. 29, 2009

(65) Prior Publication Data

US 2009/0188469 A1 Jul. 30, 2009

(30) Foreign Application Priority Data

Jan. 30, 2008 (JP) ..... 2008-019474

(51) Int. Cl.
*F02M 59/36* (2006.01)
*F02M 59/34* (2006.01)

(52) U.S. Cl. ..... 123/458; 123/514

(58) Field of Classification Search ..... 123/458, 123/506, 459, 514, 456; 701/103
See application file for complete search history.

(56) References Cited

U.S. PATENT DOCUMENTS

| | | | | |
|---|---|---|---|---|
| 6,854,445 | B2 * | 2/2005 | Okamoto | 123/446 |
| 2005/0199219 | A1 * | 9/2005 | Utsumi | 123/458 |
| 2008/0059039 | A1 * | 3/2008 | Nakagawa et al. | 701/99 |
| 2009/0240417 | A1 * | 9/2009 | Fushiki et al. | 701/103 |

FOREIGN PATENT DOCUMENTS

| | | |
|---|---|---|
| JP | 7-158536 A | 6/1995 |
| JP | 10-54318 A | 2/1998 |

* cited by examiner

*Primary Examiner* — Mahmoud Gimie
(74) *Attorney, Agent, or Firm* — Crowell & Moring LLP

(57) ABSTRACT

Disclosed herein is a fuel injector for an internal combustion engine, which includes a high pressure pump for pressure feeding high pressure fuel of the internal combustion engine; a fuel rail for accumulating the fuel that has been pressure fed by the high pressure pump; an injection valve for injecting, into a cylinder, the fuel accumulated in the fuel rail; a fuel pressure sensor for detecting the pressure of the fuel that is accumulated in the fuel rail; an electromagnetic relief valve for discharging the pressure accumulated fuel of the fuel rail; and an electronic control unit for controlling opening and closing of the electromagnetic relief valve. The electronic control unit repeats the opening and closing of the relief valve to discharge the fuel pressure in stages so that the fuel pressure in the fuel rail is decreased down to the target fuel pressure.

19 Claims, 12 Drawing Sheets

FUEL INJECTOR FOR INTERNAL COMBUSTION ENGINE

BACKGROUND OF THE INVENTION

1. Field of the Invention

The present invention relates to a fuel injector for an internal combustion engine. More particularly, the invention relates to a fuel injector for an internal combustion engine provided with a pressure control valve for controlling fuel pressure to be reduced in a fuel rail, the fuel of the internal combustion engine being pressured and accumulated in the fuel rail.

2. Description of the Related Art

To increase fuel pressure in a fuel rail during the normal operation of an engine, pressure feeding of fuel by use of a high pressure fuel pump is known. On the other hand, to decrease fuel pressure in the fuel rail, the pressure feeding of fuel by use of the high pressure pump is stopped, and the fuel is injected into each cylinder from a fuel injection valve to decrease the fuel pressure in the fuel rail. This method is generally used in the field. Such a method is intended to inject fuel only for the purpose of decreasing fuel pressure. As a result, fuel is uselessly consumed.

In contrast, JP-A-7-158536 discloses a technique in which a fuel relief valve adapted to discharge fuel when an engine is stopped is disposed in a fuel rail for use in a fuel injector for injecting fuel into each cylinder from the fuel rail through a fuel injection valve, the fuel rail accumulating the pressured fuel pressure fed by a high pressure fuel pump.

Such a fuel supply unit controls the fuel pressure such that when the fuel pressure in the fuel rail becomes higher than a specified value, a pressure control valve is opened to discharge fuel from the fuel rail until the fuel pressure becomes lower than the specified value.

However, the technique disclosed in JP-A-7-158536 can be used only when the engine is stopped.

Alternatively, JP-A-10-54318 discloses a fuel supply system in which a fuel relief valve is disposed in a fuel rail, and the fuel pressure is controlled such that when the fuel pressure rapidly decreases, one pulse is supplied to the relief valve, whereas when the fuel pressure gently decreases, an on/off pulse whose on duty is constant is supplied to the relief valve.

SUMMARY OF THE INVENTION

Since when a vehicle is decelerating, for example, the target fuel pressure for fuel recovery is low in comparison with the fuel pressure immediately before deceleration fuel cut, it is necessary to greatly decrease the fuel pressure. For example, it is necessary to decrease a fuel pressure of 15 MPa to 5 MPa.

When the fuel pressure is to be greatly decreased, if one pulse is supplied to a supply valve to decrease the fuel pressure as described in JP-A-7-158536, excessive pressure decrease or insufficient pressure decrease occurs, which will lead to instable pressure reduction control.

An object of the present invention is to provide a fuel injector for an internal combustion engine, which can achieve the improved responsiveness to the target fuel pressure as well as the improved controllability even when the fuel pressure is greatly decreased.

(1) In order to achieve the above described object, according to one aspect of the present invention, a fuel injector for an internal combustion engine is provided. The fuel injector comprises: a high pressure pump for pressure feeding high pressure fuel of the internal combustion engine; a fuel rail for accumulating the fuel which is pressure fed by the high pressure pump; an injection valve for injecting, into a cylinder, the fuel accumulated in the fuel rail; pressure detection means for detecting the pressure of the fuel accumulated in the fuel rail; target value calculation means for calculating a target value of the fuel pressure in the fuel rail; an electromagnetic relief valve for discharging the pressure accumulated fuel in the fuel rail; and control means used for repeating opening and closing of the relief valve to relieve the fuel pressure in stages so that the fuel pressure in the fuel rail is decreased down to the target fuel pressure.

The above described configuration makes it possible to achieve the improved responsiveness to the target fuel pressure as well as the improved controllability even when the fuel pressure is greatly decreased.

(2) In the above described item (1), preferably, the control means changes a relief valve opening/closing time in a time series manner.

(3) In the above described item (2), preferably, the control means sets a relief valve opening time such that the opening time is long at first and gradually decreases thereafter.

(4) In the above described item (2), preferably, the control means sets a relief valve opening time such that the opening time is short at first and then is long before the opening time gradually decreases.

(5) In the above described item (1), preferably, every time the relief valve opens, the control means measures a deviation of the current fuel pressure from the target fuel pressure to change a next relief valve opening time.

(6) In the above described item (5), preferably, when the difference between the current fuel pressure and the target fuel pressure is smaller than or equal to a specified value, the control means performs a control to stop the pressure reduction operation that is performed by the relief valve.

(7) In the above described item (1), preferably, when the fuel pressure in the fuel rail becomes lower than or equal to the target fuel pressure during the pressure reduction operation that is performed by the relief valve, the control means performs a control to stop the pressure reduction operation that is performed by the relief valve.

(8) In the above described item (1), preferably, after completion of the pressure reduction operation performed by the relief valve, the control means performs a control not to restart the pressure reduction operation which is performed by the relief valve, until the fuel pressure in the fuel rail becomes higher than or equal to a specified value.

(9) In the above described item (1), preferably, after completion of the pressure reduction operation performed by the relief valve, the control means performs a control not to restart the pressure reduction operation which is performed by the relief valve, until a given period of time elapses.

(10) In the above described item (1), preferably, while the pressure reduction operation is performed by the relief valve, the control means performs a control to stop the pressure feeding of fuel by the high pressure pump.

(11) In the above described item (1), preferably, when the fuel pressure calculation means is out of order, the control means performs a control to stop the pressure reduction operation which is performed by the relief valve.

(12) In the above described item (1), preferably, when the pressure feeding capability of the high pressure fuel pump decreases, the control means performs a control to stop the pressure reduction operation that is performed by the relief valve.

According to the present invention, even when the fuel pressure is greatly decreased, the improved responsiveness to the target fuel pressure as well as the improved controllability can be achieved.

BRIEF DESCRIPTION OF THE DRAWINGS

FIGS. 9(A) through 9(D) are timing charts each illustrating the pressure reduction control carried out by the fuel injector for the internal combustion engine according to the first embodiment of the present invention;

FIGS. 1(A) through 10(D) are timing charts each illustrating the pressure reduction control carried out by a fuel injector for an internal combustion engine according to a second embodiment of the present invention;

DESCRIPTION OF THE PREFERRED EMBODIMENTS

The configuration of a fuel injector for an internal combustion engine according to a first embodiment of the present invention, and the operation thereof, will be described below with reference to FIGS. 1 through 9.

First, the configuration of a system in which the fuel injector for the internal combustion engine according to this embodiment is applied to a direct injection gasoline engine fuel supply unit will be described with reference to FIG. 1.

Figure 1:
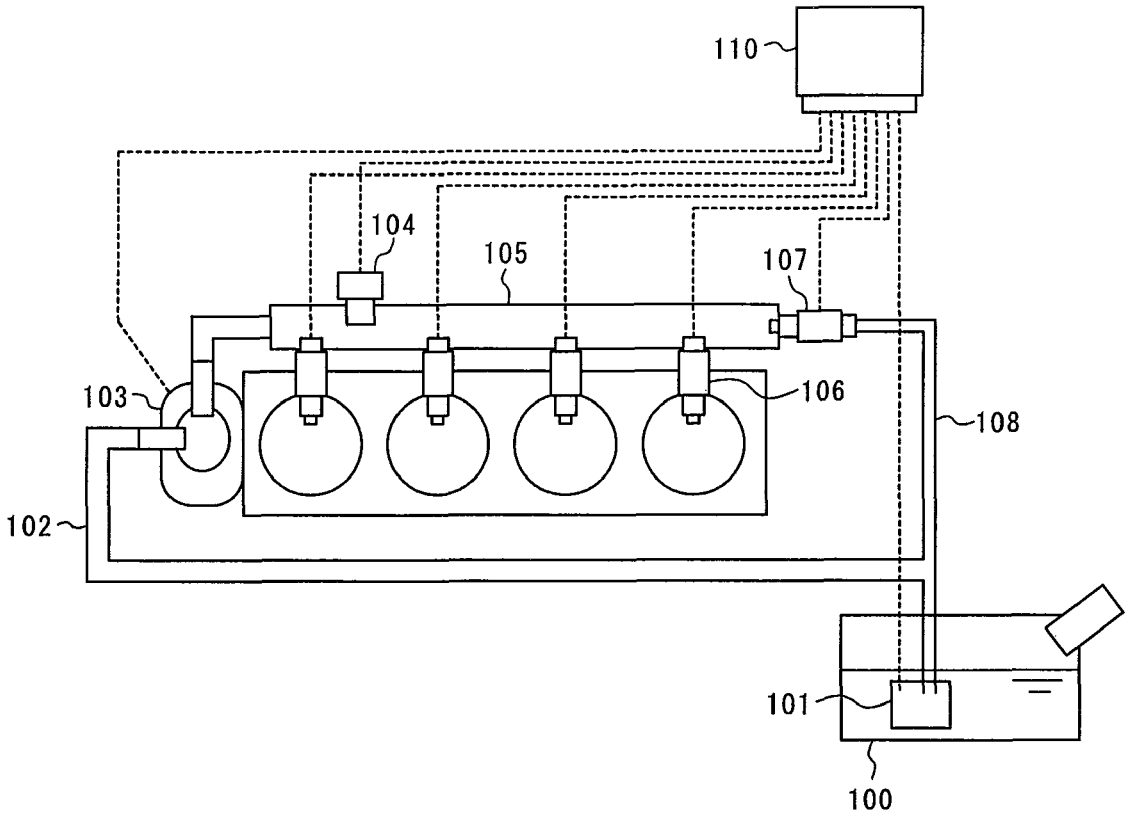
FIG. 1 is a diagram illustrating the configuration of a system in which a fuel injector for an internal combustion engine according to a first embodiment of the present invention is applied to a direct injection gasoline engine fuel supply unit.

FIG. 1 is a diagram illustrating the configuration of the system in which the fuel injector for the internal combustion engine according to the first embodiment of the present invention is applied to the direct injection gasoline engine fuel supply unit.

Fuel stored in a fuel tank 100 is pumped by a low pressure fuel pump 101, and is passed through a fuel filter (not illustrated). The fuel is then supplied to a high pressure fuel pump 103 through a low pressure pipe 102. The pressure of the fuel to be supplied to the high pressure fuel pump 103 is adjusted to a value ranging from 0.3 MPa to 0.5 MPa by a low pressure regulator (not illustrated). The pressure of the fuel which has been supplied to the high pressure fuel pump 103 is increased to a value ranging from about 3 MPa to about 20 MPa. The fuel is then accumulated in a fuel rail 105. The fuel pressure is usually controlled in response to a load of an engine. When the load of the engine is high, the fuel pressure is made high, whereas when the load of the engine is low, the fuel pressure is made low. The load of the engine is judged from the amount of intake air, an accelerator opening degree, the engine speed, and the like.

Each injector 106, which is disposed in each cylinder of the engine, supplies the each cylinder with the fuel which has been pressured and accumulated in the fuel rail 105. The fuel is then combusted in the each cylinder. The pressure of the fuel, which has been accumulated in the fuel rail 105, is detected by a fuel pressure sensor 104. The pressure is then transmitted to an ECU 110 as a fuel pressure sensor signal. The fuel rail 105 is further provided with an electromagnetic relief valve 107 for adjusting the fuel pressure. The relief valve 107 is opened/closed on the basis of a control signal from the ECU 110. When the relief valve is kept opened, the fuel stored in the fuel rail is exhausted to a low pressure relief pipe 108. As a result, the fuel pressure in the fuel rail is decreased.

The fuel, which has been exhausted from the relief valve 107, is supplied to the high pressure fuel pump 103 again through the low pressure pipe 102. The high pressure fuel pump 103 then supplies the fuel to the fuel rail 105. The ECU 110 reads not only a fuel pressure sensor signal but also signals indicating the engine speed, the amount of engine intake air, an accelerator position, and an engine state (for example, the engine water temperature) so that the fuel injection quantity, and target fuel pressure, are calculated.

Next, how the fuel injector for the internal combustion engine according to this embodiment is controlled will be described with reference to FIGS. 2 through 7.

First, the overall fuel pressure control carried out by the fuel injector for the internal combustion engine according to this embodiment will be described with reference to FIG. 2.

Figure 2:
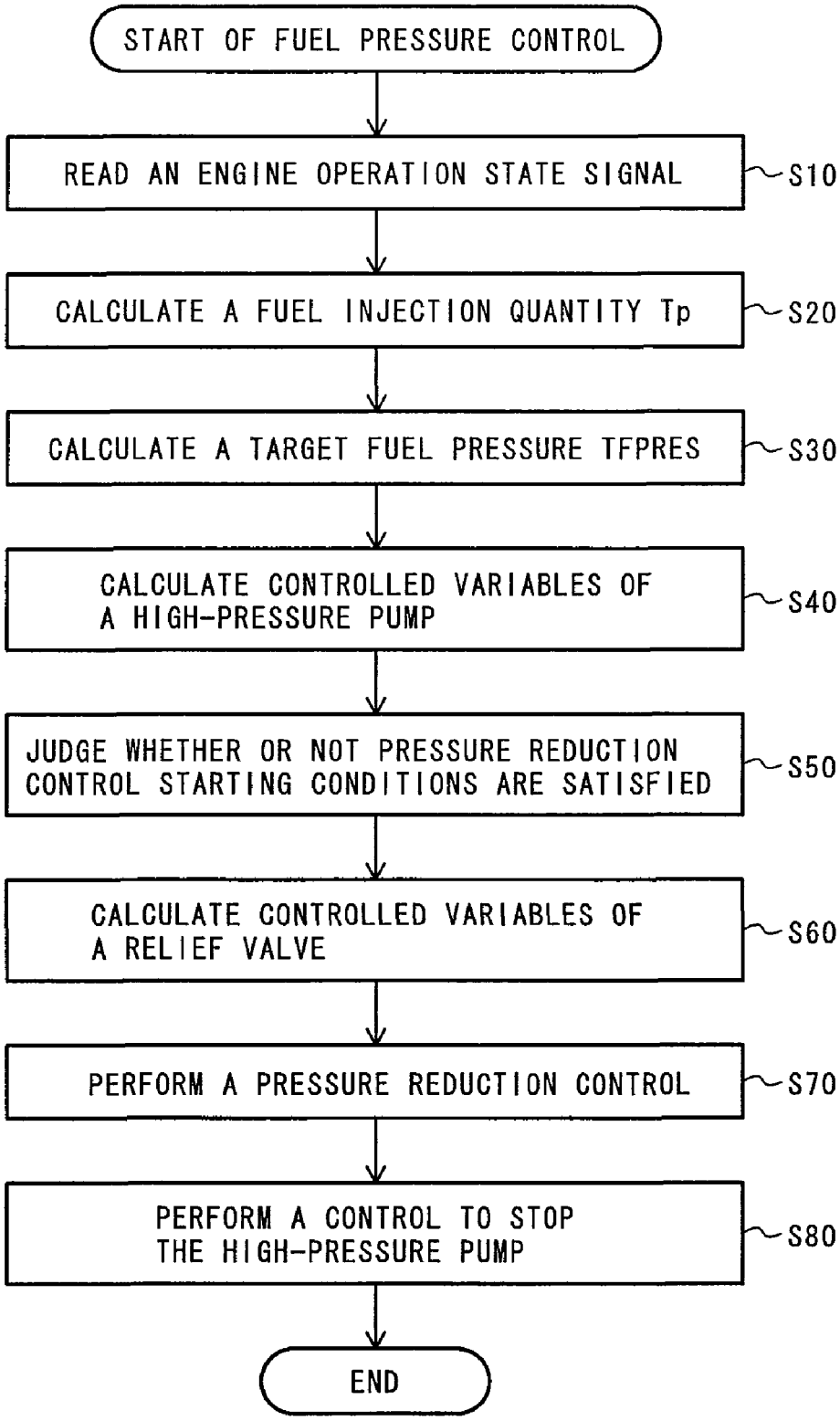
FIG. 2 is a flowchart illustrating the overall fuel pressure control carried out by the fuel injector for the internal combustion engine according to the first embodiment of the present invention.

FIG. 2 is a flowchart illustrating the overall fuel pressure control carried out by the fuel injector for the internal combustion engine according to the first embodiment of the present invention.

In a step S10, the ECU 110 reads signals indicating the engine speed, the amount of engine intake air, an accelerator position, and an engine state (for example, the engine water temperature, and the fuel pressure).

In a step S20, the ECU 110 calculates, from the engine state inputted in the step S10, the fuel injection quantity to be supplied to each cylinder of the engine.

In a step S30, the ECU 110 calculates the target pressure of the pressure accumulated fuel in the fuel rail from the engine state inputted in the step S10.

In a step S40, according to the fuel pressure calculated in the step S20, the ECU 110 calculates controlled variables of the high pressure pump to be used when the fuel pressure in the fuel rail is controlled through a high pressure pipe by a high pressure fuel pump.

In a step S50, the ECU 110 judges whether or not pressure reduction control starting conditions are satisfied. Incidentally, how to judge whether or not the pressure reduction control starting conditions are satisfied will be described in detail later with reference to FIG. 3.

Next, in a step S60, the ECU 110 calculates controlled variables of the relief valve.

In a step S70, the ECU 110 controls the pressure of the pressure accumulated fuel in the fuel rail in a pressure reduction direction on the basis of the controlled variables of the relief valve calculated in the step S60. The pressure reduction control will be described in detail later with reference to FIG. 4.

In addition, when the pressure reduction control is started, the ECU 110 performs a control to stop the high pressure pump in the step S70.

Next, the judgment of the pressure reduction control starting conditions in the step S50 shown in FIG. 2 will be described with reference to FIG. 3. This judgment processing is included in the fuel pressure control carried out by the fuel injector for the internal combustion engine according to this embodiment.

Figure 3:
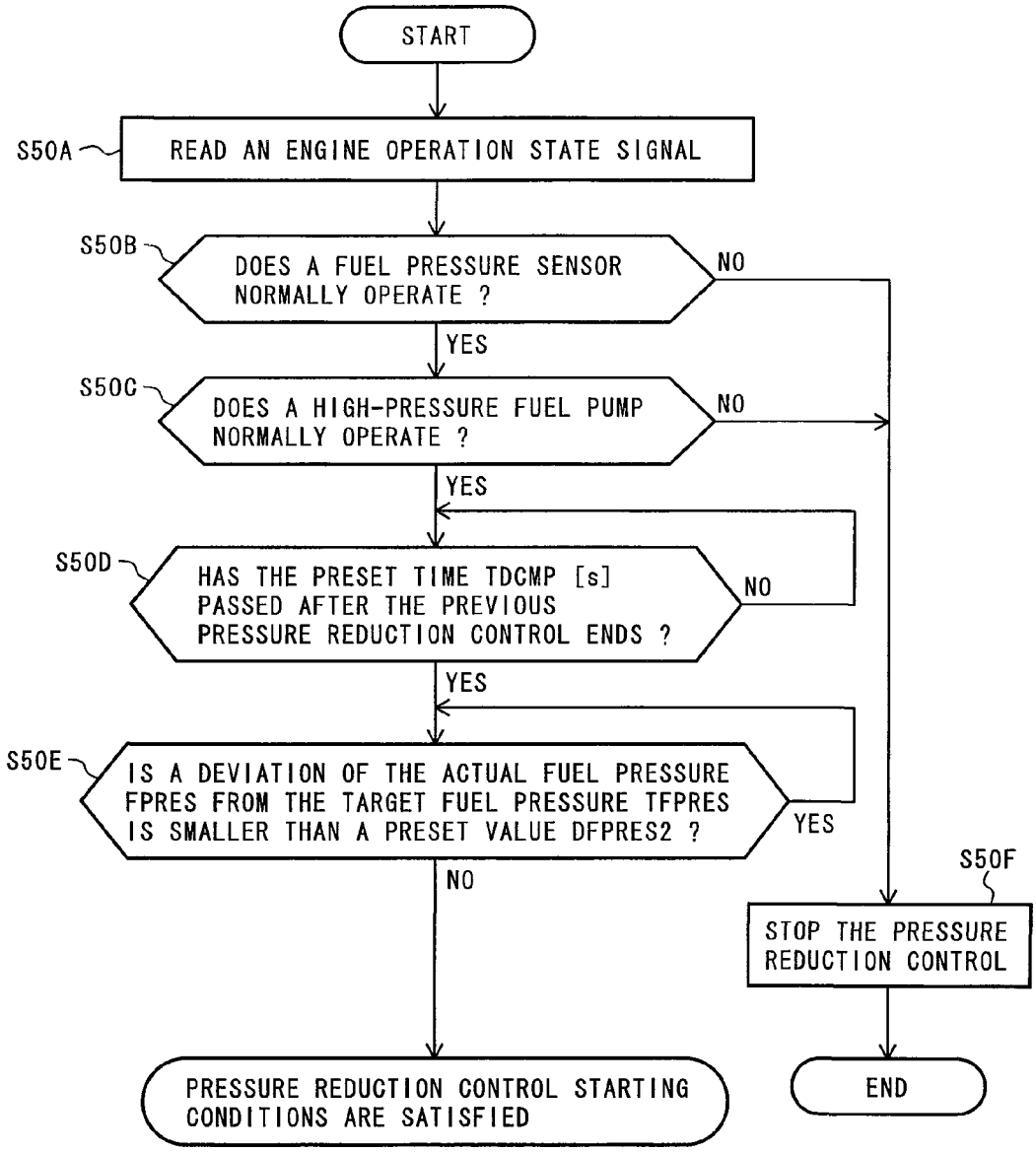
FIG. 3 is a flowchart illustrating judgment processing of pressure reduction control starting conditions in a step S50 shown in FIG. 2, the judgment processing being included in the fuel pressure control carried out by the fuel injector for the internal combustion engine according to the first embodiment.

FIG. 3 is a flowchart illustrating the judgment processing of the pressure reduction control starting conditions in the step S50 shown in FIG. 2. This judgment processing is included in the fuel pressure control carried out by the fuel injector for the internal combustion engine according to this embodiment.

In a step S50A, the ECU 110 reads a signal indicating an engine state.

Next, in a step S50B, the ECU 110 judges whether or not the fuel pressure sensor 104 for detecting the pressure of the pressure accumulated fuel in the fuel rail normally operates. The judgment as to whether or not the fuel pressure sensor normally operates can be made by a numerical value of the fuel pressure detected by the fuel pressure sensor. For example, when the high pressure fuel pump 103 increases the fuel pressure to a value ranging from about 3 MPa to about 20 MPa in the configuration show in FIG. 1, the numerical value of the fuel pressure detected by the fuel pressure sensor never go out of this numerical value range. Therefore, for example, when the numerical value detected by the fuel pressure sensor 104 is 1 MPa or less (or 25 MPa or more), it is judged that the fuel pressure sensor 104 does not normally operate. When it is judged that the fuel pressure sensor 104 normally operates, the process proceeds to a step S50C. In contrast, when it is judged that the fuel pressure sensor 104 does not normally operate, the correct fuel pressure cannot be obtained, and thus the fuel control by the relief valve according to this embodiment cannot also be correctly executed. Accordingly, in a step S50F, the pressure reduction control is stopped, before the process ends.

When it is judged that the fuel pressure sensor normally operates, the ECU 110 makes a judgment in a step S50C as to whether or not the high pressure fuel pump 103 for pressure feeding the pressure accumulated fuel into the fuel rail normally operates. When the high pressure fuel pump 103 is driven by the engine, the discharge pressure of the high pressure fuel pump 103 is proportional to the engine speed. Therefore, the discharge pressure calculated from the engine speed is compared with the fuel pressure detected by the fuel pressure sensor 104. When the difference between them is larger than or equal to a specified value, it is possible to judge that the high pressure fuel pump 103 does not normally operate. When it is judged that the high pressure fuel pump normally operates, the process proceeds to a step S50D. In contrast, when it is judged that the high pressure fuel pump does not normally operate, it is difficult to increase the fuel pressure in the fuel rail. This makes it impossible to correctly execute the fuel control by the relief valve according to this embodiment. Accordingly, in a step S50F, the pressure reduction control is stopped, before the process ends.

When it is judged that the high pressure fuel pump normally operates, the ECU 110 makes a judgment in the step S50D as to whether or not the preset time TDCMP [s] has passed after the previous fuel pressure control by the relief valve ends. When it is judged that the preset time TDCMP [s] has passed after the end of the previous fuel pressure control by the relief valve, the process proceeds to a step S50E. In contrast, when it is judged that the preset time TDCMP [s] has not passed after the end of the previous fuel pressure control by the relief valve, the fuel pressure control according to this embodiment is frequently started. Therefore, in order to prevent the fuel pressure in the fuel rail from fluctuating, this judgment is repeated.

When the preset time TDCMP [s] has passed, the ECU 110 makes a judgment in the step S50E as to whether or not a deviation of the current actual fuel pressure FPRES from the target fuel pressure TFPRES is larger than a preset value DFPRES2. When it is judged that the deviation of the current actual fuel pressure FPRES from the target fuel pressure TFPRES is larger than the preset value DFPRES2, fuel pressure control conditions of the relief valve according to this embodiment are satisfied. In contrast, when it is judged that the deviation of the current actual fuel pressure FPRES from the target fuel pressure TFPRES is smaller than the preset value DFPRES2, the fuel pressure control according to this embodiment is frequently started. Therefore, in order to prevent the fuel pressure in the fuel rail from fluctuating, the judgment is repeated until the fuel pressure control conditions are satisfied.

Next, the pressure reduction control processing in the step S70 shown in FIG. 2 will be described with reference to FIG. 4. This pressure reduction control processing is included in the fuel pressure control carried out by the fuel injector for the internal combustion engine according to this embodiment.

Figure 4:
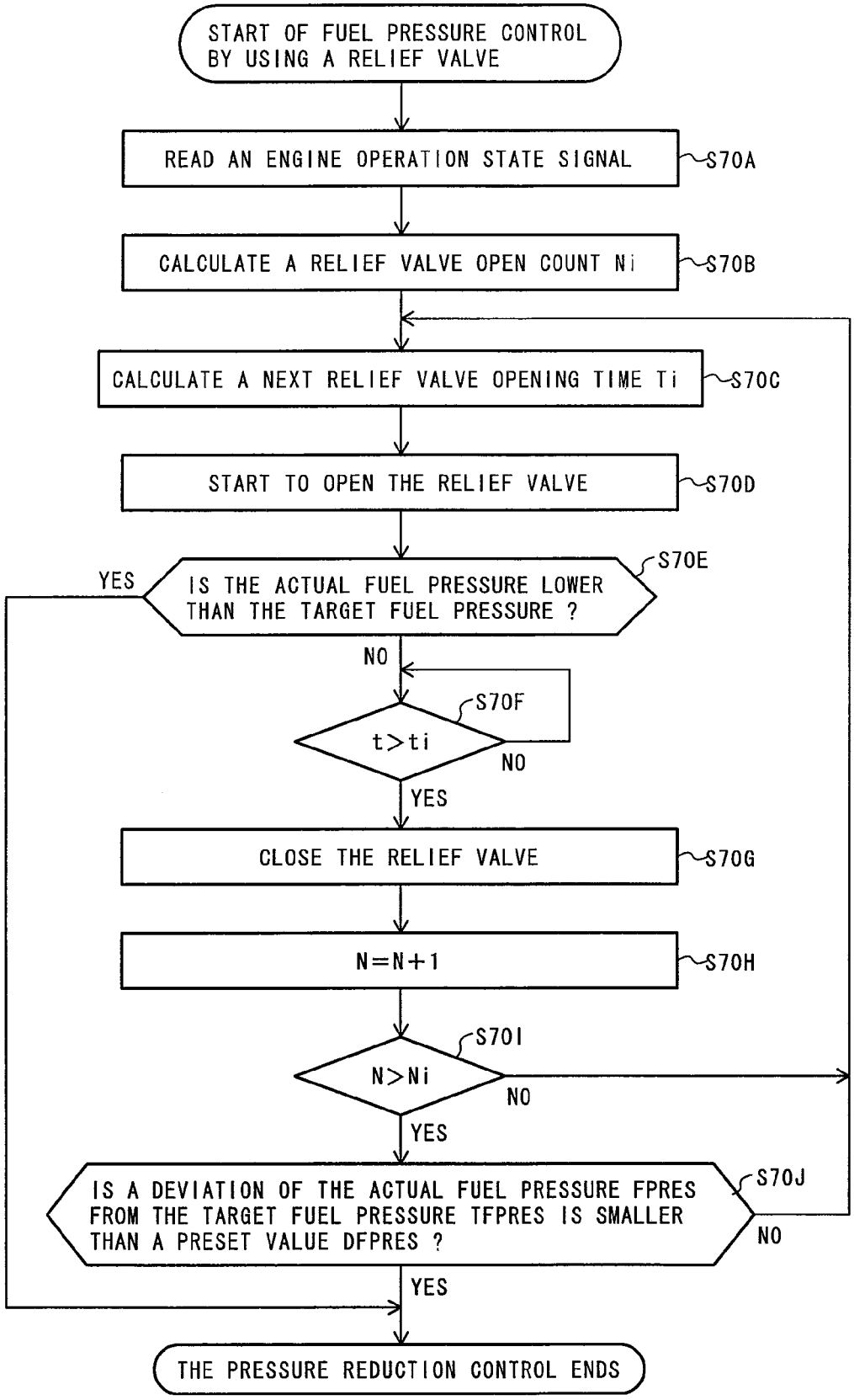
FIG. 4 is a flowchart illustrating pressure reduction control processing in a step S70 shown in FIG. 2, the pressure reduction control processing being included in the fuel pressure control carried out by the fuel injector for the internal combustion engine according to the first embodiment.

FIG. 4 is a flowchart illustrating the pressure reduction control processing in the step S70 shown in FIG. 2. This pressure reduction control processing is included in the fuel pressure control carried out by the fuel injector for the internal combustion engine according to this embodiment.

In a step S70A, the ECU 110 reads signals indicating the engine speed, the amount of engine intake air, an accelerator position, and an engine state (for example, the engine water temperature, and the fuel pressure).

Next, in a step S70B, on the basis of the deviation of the current actual fuel pressure from the target fuel pressure, and information including the engine speed, the amount of engine intake air, the circulating water temperature, the vehicle speed, and a throttle opening angle, the ECU 110 calculates a relief valve open count Ni that indicates the number of times the relief valve opens to achieve the target pressure.

Here, how to calculate the relief valve open count Ni by the fuel injector for the internal combustion engine according to this embodiment will be described with reference to FIG. 5.

Figure 5:
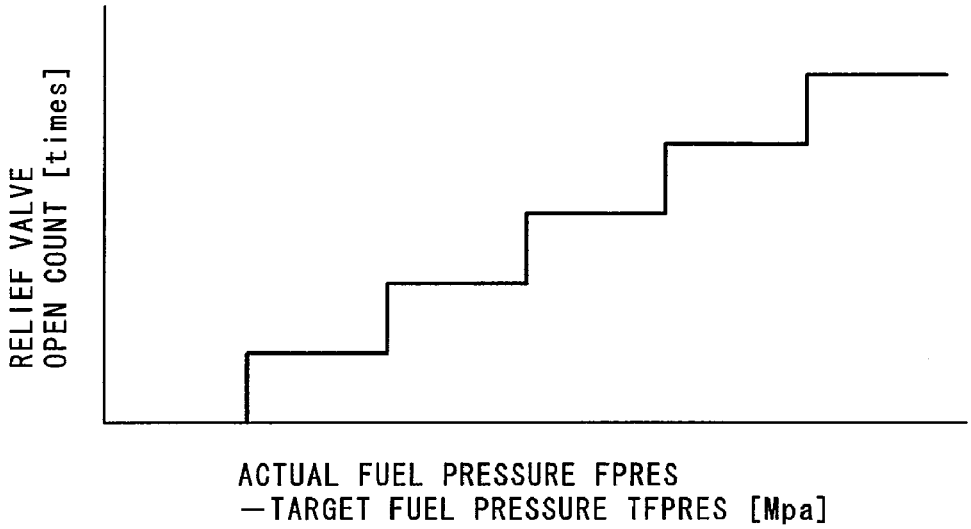
FIG. 5 is a chart illustrating calculation processing of the relief valve open count Ni in the fuel injector for the internal combustion engine according to the first embodiment of the present invention.

FIG. 5 is a chart illustrating calculation processing of the relief valve open count Ni by the fuel injector for the internal combustion engine according to the first embodiment of the present invention.

In the step S70B shown in FIG. 4, on the basis of a deviation of the actual fuel pressure FPRES from the target fuel pressure TFPRES, the ECU 110 sets the relief valve open count Ni such that the relief valve open count Ni increases with the increase in deviation.

Incidentally, as described above, the relief valve open count Ni can also be calculated from the engine speed, the amount of engine intake air, the circulating water temperature, the vehicle speed, a throttle opening angle, etc.

Returning to FIG. 4, in a step S70C, the ECU 110 calculates a relief valve opening time ti.

Here, how to calculate the relief valve opening time ti in the fuel injector for the internal combustion engine according to this embodiment will be described with reference to FIGS. 6 and 7.

Figure 6:
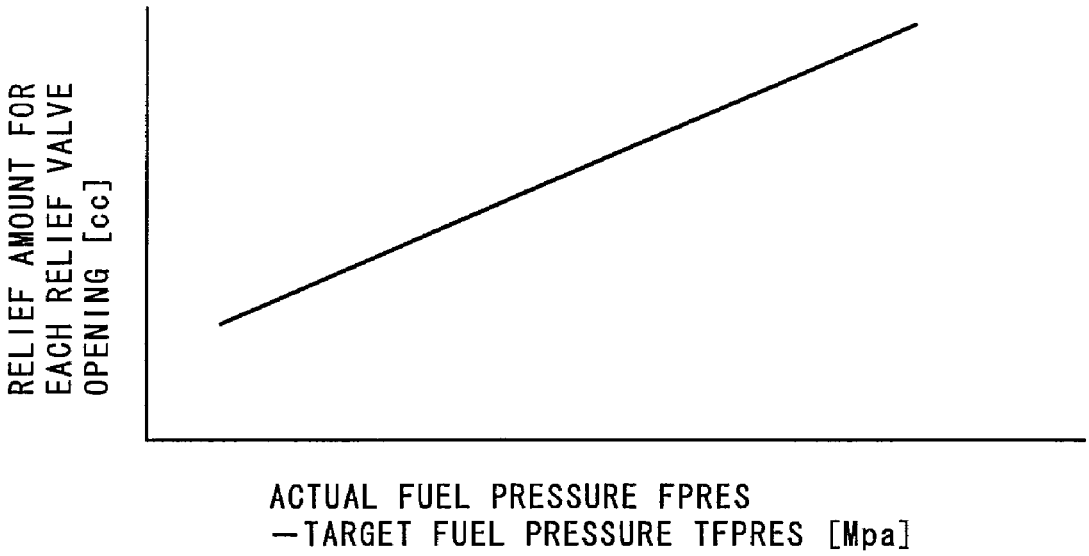
FIG. 6 is a chart illustrating calculation processing of the relief valve opening time ti in the fuel injector for the internal combustion engine according to the first embodiment of the present invention.
Figure 7:
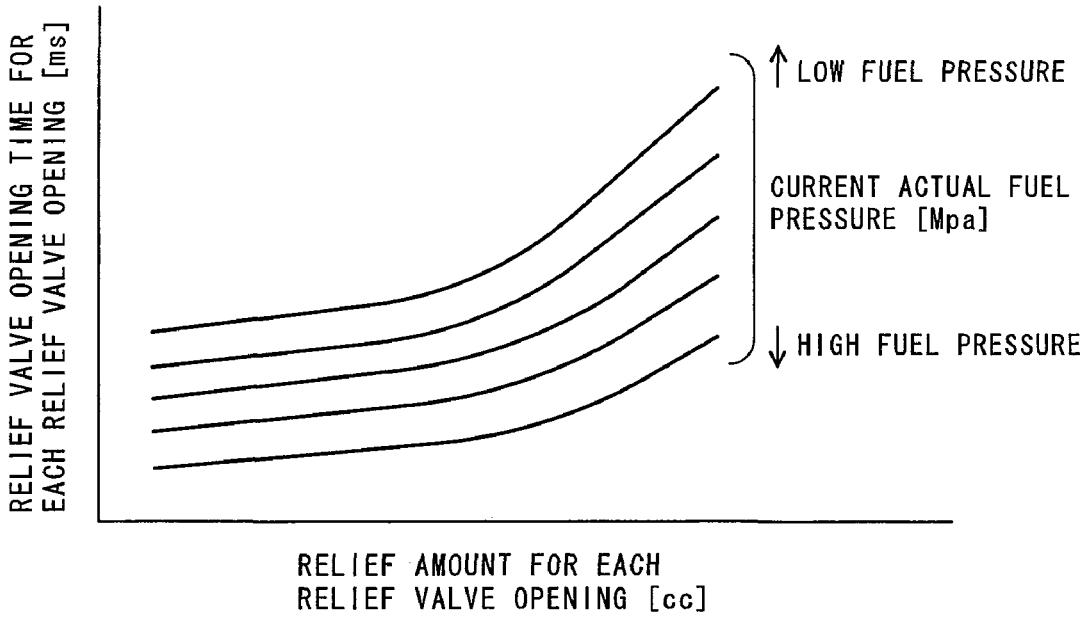
FIG. 7 is a chart illustrating calculation processing of the relief valve opening time ti in the fuel injector for the internal combustion engine according to the first embodiment of the present invention.

FIGS. 6 and 7 are diagrams each illustrating processing of calculating the relief valve opening time ti in the fuel injector for the internal combustion engine according to the first embodiment of the present invention.

In FIG. 6, the horizontal axis indicates the deviation of the actual fuel pressure FPRES from the target fuel pressure TFPRES, whereas the vertical axis indicates the amount of fuel discharged from the fuel rail by use of the relief valve for each relief valve opening.

As shown in FIG. 6, the amount of fuel discharged from the fuel rail is set on the basis of the deviation of the actual fuel pressure FPRES from the target fuel pressure TFPRES. The relief amount is set at a larger value with the increase in deviation.

In FIG. 7, the horizontal axis indicates a relief amount for each relief valve opening; and the vertical axis indicates a relief valve opening time.

As shown in FIG. 7, the relief amount for each relief valve opening is set such that the relief valve opening time increases with the increase in the relief amount, and such that the relief valve opening time decreases with the increase in fuel pressure. This is because the relief amount increases with the increase in actual fuel pressure even when the opening time is the same.

Next, returning to FIG. 4, in a step S70D, the ECU 110 discharges the pressure accumulated fuel in the fuel rail to the low pressure side by actually opening the relief valve 107.

Next, in a step S70E, the ECU 110 compares the current actual fuel pressure FPRES with the target fuel pressure TFPRES. When the actual fuel pressure FPRES becomes lower than the target fuel pressure TFPRES, the fuel pressure control by the relief valve of the fuel supply unit according to the present invention ends. In contrast, when the actual fuel pressure FPRES is higher than the target fuel pressure TFPRES, the process proceeds to a step S70F.

In the step S70F, the ECU 110 monitors the elapsed time t after the relief valve opens in the step S70D. When the elapsed time t exceeds the relief valve opening time ti, which has been calculated in the step S70C, the process proceeds to a step S70G in which the relief valve is closed.

Next, in a step S70H, the ECU 110 adds one to a numerical value N. After that, in a step S70I, the ECU 110 judges whether or not the numerical value N exceeds the relief valve open count Ni that has been calculated in the step S70B. When it is judged that the numerical value N has not exceeded the relief valve open count Ni, the process returns to the step S70C, and the processing is continued. When it is judged that the numerical value N has exceeded the relief valve open count Ni, the process proceeds to a step S70J.

Next, in a step S70J, the ECU 110 calculates a deviation of the current actual fuel pressure FPRES from the target fuel pressure TFPRES, and then judges whether or not this deviation is larger than a preset value DFPRES. When it is judged that the deviation of the current actual fuel pressure FPRES from the target fuel pressure TFPRES is larger than the preset value DFPRES, the process returns to the step S70B, and then a next relief valve opening time is calculated again. In contrast, when it is judged that the deviation of the current actual fuel pressure FPRES from the target fuel pressure TFPRES is smaller than the preset value DFPRES, the fuel pressure control by the relief valve of the fuel supply unit according to this embodiment ends.

Here, the preset value DFPRES used in the fuel injector for the internal combustion engine according to this embodiment will be described with reference to FIG. 8.

Figure 8:
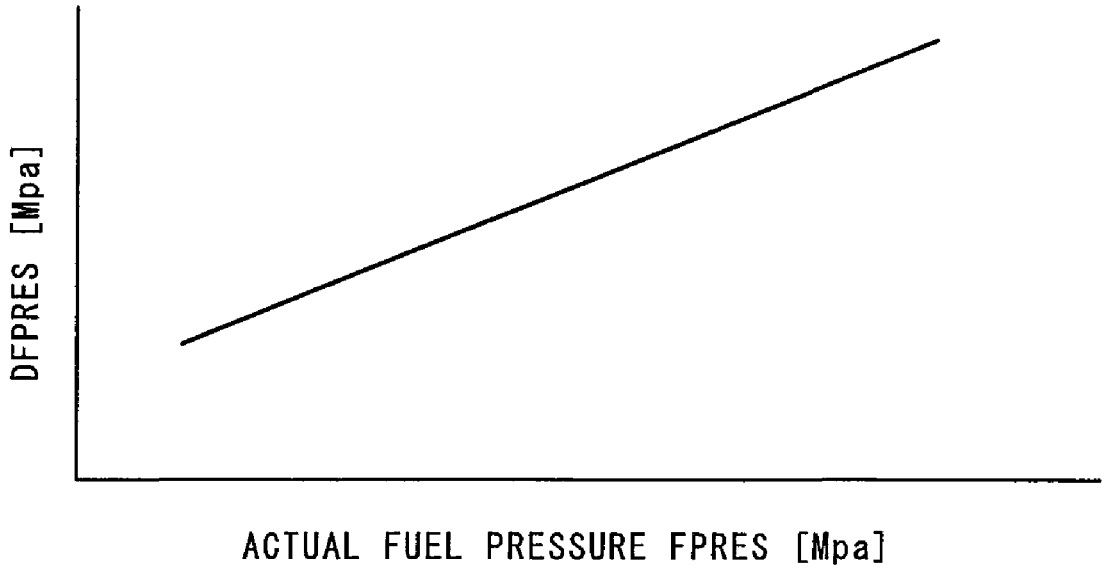
FIG. 8 is a chart illustrating a preset value DFPRES used in the fuel injector for the internal combustion engine according to the first embodiment of the present invention.
Figure 9:
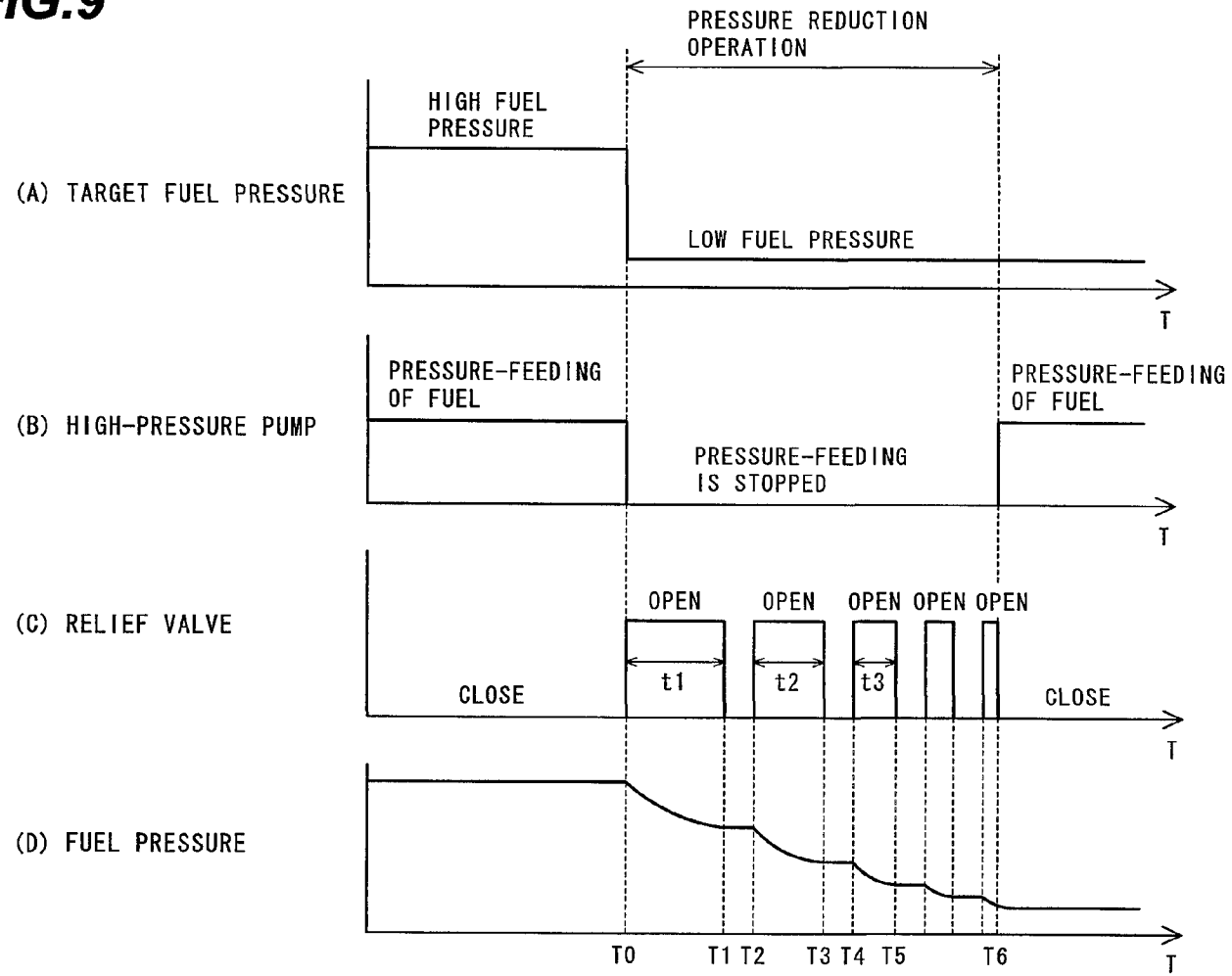
Figure 10:
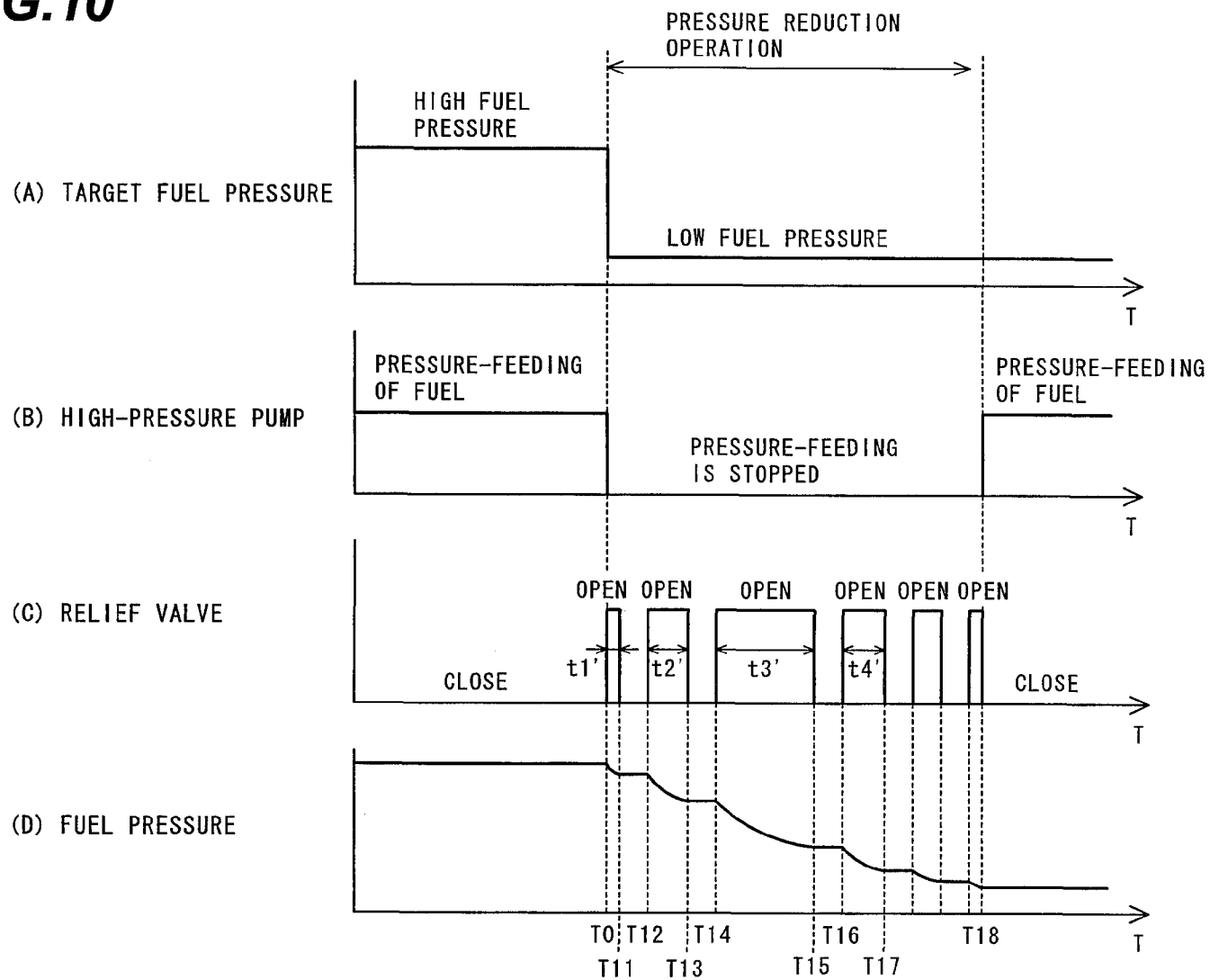

FIG. 8 is a chart illustrating a preset value DFPRES used in the fuel injector for the internal combustion engine according to the first embodiment of the present invention.

In the step S70J, a judgment is made as to whether or not the deviation of the current actual fuel pressure FPRES from the target fuel pressure TFPRES is larger than the preset value DFPRES. In this case, as shown in FIG. 8, the preset value DFPRES is set such that the preset value DFPRES increases with the increase in actual fuel pressure FPRES. This is because the relief amount based on the minimum opening time of the relief valve increases in response to the actual fuel pressure. Accordingly, the preset value DFPRES is set always keeping a value larger than the relief amount based on the minimum opening time.

Here, how the pressure reduction control is carried out by the fuel injector for the internal combustion engine according to this embodiment will be described with reference to FIGS. 9(A) through 9(D).

FIGS. 9(A) through 9(D) are timing charts each illustrating the pressure reduction control carried out by the fuel injector for the internal combustion engine according to the first embodiment of the present invention.

In FIGS. 9(A) through 9(D), each horizontal axis indicates the time T. The vertical axis of FIG. 9(A) indicates the target fuel pressure; the vertical axis of FIG. 9(B) indicates the operation of the high pressure pump; the vertical axis of FIG. 9(C) indicates opened and closed states of the relief valve; and the vertical axis of FIG. 9(D) indicates the fuel pressure.

As shown in FIG. 9(A), it is assumed that the target fuel pressure decreases from "high fuel pressure" (for example, 15 MPa) to "low fuel pressure" (for example, 5 MPa) at the time T0. As a result, in the step S50E shown in FIG. 3, the deviation of the current actual fuel pressure FPRES from the target fuel pressure TFPRES becomes larger than a preset value DFPRES2. Accordingly, fuel pressure control conditions of the relief valve are satisfied.

Next, in the step S70B shown in FIG. 4, the relief valve open count Ni is set on the basis of the deviation of the actual fuel pressure FPRES from the target fuel pressure TFPRES. In the example shown in FIGS. 9(A) to 9(D), the relief valve open count Ni is set at five (or, five or more). Then, in the step S70C shown in FIG. 4, the relief valve opening time ti is calculated. After that, in the step S70D shown in FIG. 4, opening of the relief valve starts. As shown in FIG. 9(C), the relief valve is kept opened during a period from the time T0 to the time T1 (during a time period t1); and the relief valve is closed at the time T1.

Subsequently, the relief valve is kept opened during a period from the time T2 to the time T3 (during a time period t2); and the relief valve is closed at the time T3.

At the time T6, when the deviation of the current actual fuel pressure FPRES from the target fuel pressure TFPRES becomes smaller than the preset value DFPRES, the fuel pressure control by the relief valve of the fuel supply unit ends.

Next, as shown in FIG. 9(B), pressure feeding of fuel by the high pressure pump is restarted.

Here, the calculation of the relief valve opening time ti in the step S70C shown in FIG. 4 is based on the deviation of the actual fuel pressure FPRES from the target fuel pressure TFPRES, which is indicated by the horizontal axis shown in FIG. 6. Accordingly, the relief amount is set at a larger value with the increase in deviation of the actual fuel pressure FPRES from the target fuel pressure TFPRES. As a result, as shown in FIG. 7, the relief valve opening time increases with the increase in deviation of the actual fuel pressure FPRES from the target fuel pressure TFPRES.

Therefore, the relief valve opening time ti is longer than the next relief valve opening time t2. In other words, the relief valve opening time is configured to gradually decrease. For example, on the assumption that the relief valve opening time is t1 at first, the next relief valve opening time t2 is shorter than the opening time t1, and the relief valve opening time t3 next is shorter than the opening time t2. Lengthening the relief valve opening time at first makes it possible to shorten the time required for the pressure reduction control. On the one hand, when the deviation of the actual fuel pressure FPRES from the target fuel pressure TFPRES decreases, the relief valve opening time is shortened. Therefore, by decreasing the relief amount for each relief valve opening, the actual fuel pressure FPRES can be controlled with respect to the target fuel pressure TFPRES with high accuracy.

As described above, according to this embodiment, the fuel pressure is decreased in stages in such a manner that the first pressure reduction is large, and the pressure reduction gradually becomes smaller thereafter. This makes it possible to perform the pressure reduction control that can achieve both the responsiveness and convergence of the pressure reduction. Moreover, the influence of variations in flow rate can be reduced to the utmost. The variations in flow rate are caused by variations in individual relief valves, and by the deterioration with time.

Next, the configuration and operation of the fuel injector for the internal combustion engine according to a second embodiment of the present invention will be described with reference to FIGS. 10(A) to 10(D) and FIG. 11. It is to be noted that a system configuration in which the fuel injector for the internal combustion engine according to this embodiment is applied to a direct injection gasoline engine fuel supply unit is the same as that shown in FIG. 1. In addition, the overall fuel pressure control carried out by the fuel injector for the internal combustion engine according to this embodiment is the same as that shown in FIG. 2. Moreover, processing of judging pressure reduction control starting conditions in the step S50 shown in FIG. 2 is the same as that shown in FIG. 3. Further, processing of the pressure reduction control in the step S70 shown in FIG. 2 is the same as that shown in FIG. 4.

Figure 11:
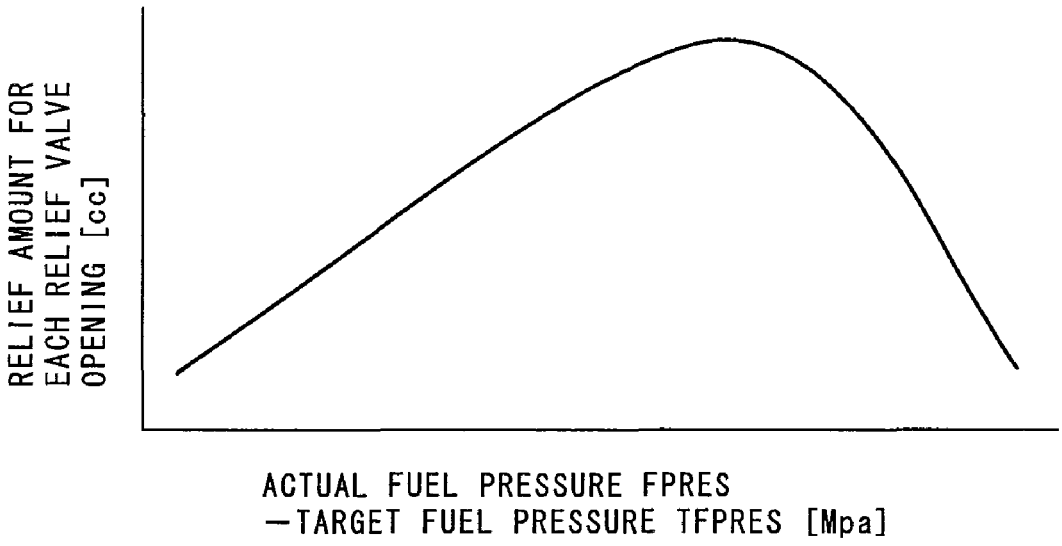
FIG. 11 is a chart illustrating calculation processing of the relief valve opening time ti in the fuel injector for the internal combustion engine according to the second embodiment of the present invention.

FIGS. 10(A) through 10(D) are timing charts each illustrating the pressure reduction control carried out by the fuel injector for the internal combustion engine according to the second embodiment of the present invention. FIG. 11 is a chart illustrating calculation processing of the relief valve opening time ti in the fuel injector for the internal combustion engine according to the second embodiment of the present invention.

In FIGS. 10(A) through 10(D), each horizontal axis indicates the time T. The vertical axis of FIG. 10(A) indicates the target fuel pressure; the vertical axis of FIG. 10(B) indicates the operation of the high pressure pump; the vertical axis of FIG. 10(C) indicates opened and closed states of the relief valve; and the vertical axis of FIG. 10(D) indicates the fuel pressure.

As shown in FIG. 10(A), it is assumed that the target fuel pressure decreases from "high fuel pressure" (for example, 15 MPa) to "low fuel pressure" (for example, 5 MPa) at the time T0. As a result, in the step S50E shown in FIG. 3, the deviation of the current actual fuel pressure FPRES from the target fuel pressure TFPRES becomes larger than a preset value DFPRES2. Accordingly, fuel pressure control conditions of the relief valve are satisfied.

Next, in the step S70B shown in FIG. 4, the relief valve open count Ni is set on the basis of the deviation of the actual fuel pressure FPRES from the target fuel pressure TFPRES. In the example shown in FIGS. 10(A) to 10(D), the relief valve open count Ni is set at six (or, six or more). Then, in the step S70C shown in FIG. 4, the relief valve opening time ti is calculated. After that, in the step S70D shown in FIG. 4, opening of the relief valve starts. As shown in FIG. 10(C), the relief valve is kept opened during a period from the time T0 to the time T11 (during a time period t1'); and the relief valve is closed at the time T11.

Subsequently, the relief valve is kept opened during a period from the time T12 to the time T13 (during a time period t2'); and the relief valve is closed at the time T13. Further, the relief valve is kept opened during a period from the time T14 to the time T15 (during a time period t3'); and the relief valve is closed at the time T15. Moreover, the relief valve is kept opened during a period from the time T16 to the time T17 (during a time period t4'); and the relief valve is closed at the time T17.

At the time T18, when the deviation of the current actual fuel pressure FPRES from the target fuel pressure TFPRES becomes smaller than the preset value DFPRES, the fuel pressure control by the relief valve of the fuel supply unit ends.

Next, as shown in FIG. 10(B), pressure feeding of fuel by the high pressure pump is restarted.

Here, the relief valve opening time t1' is shorter than the next relief valve opening time t2'. In addition, the relief valve opening time t2' is shorter than the relief valve opening time t3' next. The relief valve opening time t4' is shorter than the relief valve opening time t3'.

To be more specific, in the early stage of the pressure reduction control, the relief valve opening time is gradually lengthened. After that, the relief valve opening time is gradually shortened.

In order to control the relief valve opening time as described above, instead of using the chart shown in FIG. 6, a chart shown in FIG. 11 is used to calculate the relief valve opening time ti in the step S70C shown in FIG. 4.

In FIG. 11, the horizontal axis indicates the deviation of the actual fuel pressure FPRES from the target fuel pressure TFPRES, whereas the vertical axis indicates the amount of fuel discharged from the fuel rail by use of the relief valve for each relief valve opening.

As shown in FIG. 11, the amount of fuel discharged from the fuel rail is set on the basis of the deviation of the actual fuel pressure FPRES from the target fuel pressure TFPRES. In a stage in which the deviation is small, the relief amount is set at a larger value with the increase in deviation. However, when the deviation exceeds a specified deviation, the relief amount is set at a smaller value with the increase in deviation.

As a result, in the early stage of the pressure reduction control, the relief valve opening time can be set at a comparatively small value. When the deviation of the actual fuel pressure FPRES from the target fuel pressure TFPRES is extremely large, the excessively long valve opening time at first causes the fuel pressure to largely decrease. Therefore, there is a possibility that hunting of the fuel pressure will occur. In such a case, in the early stage of the pressure reduction control, the comparatively short valve opening time can prevent the hunting from occurring. In or after a stage in which the fuel pressure is decreased to some extent, as is the case with FIGS. 9(A) to 9(D), lengthening the relief valve opening time at first makes it possible to shorten the time required for the pressure reduction control. On the other hand, when the deviation of the actual fuel pressure FPRES from the target fuel pressure TFPRES decreases, the relief valve opening time is shortened. Therefore, by decreasing the relief amount for each relief valve opening, the actual fuel pressure FPRES can be controlled with respect to the target fuel pressure TFPRES with high accuracy.

As described above, according to this embodiment, the fuel pressure is decreased in stages in such a manner that the first pressure reduction is large, and the pressure reduction gradually becomes smaller thereafter. This makes it possible to perform the pressure reduction control that can achieve both the responsiveness and convergence of the pressure reduction. In addition, it is possible to prevent hunting of the fuel pressure from occurring. The hunting of the fuel pressure is caused by the sudden pressure reduction at the start of the pressure reduction. Moreover, the influence of variations in flow rate can be reduced to the utmost. The variations in flow rate are caused by variations in individual relief valves, and by the deterioration with time.

Next, the configuration of a system in which the fuel injector for the internal combustion engine according to the embodiments shown in FIGS. 1 through 11 is applied to a direct injection gasoline engine fuel supply unit will be described with reference to FIG. 12.

Figure 12:
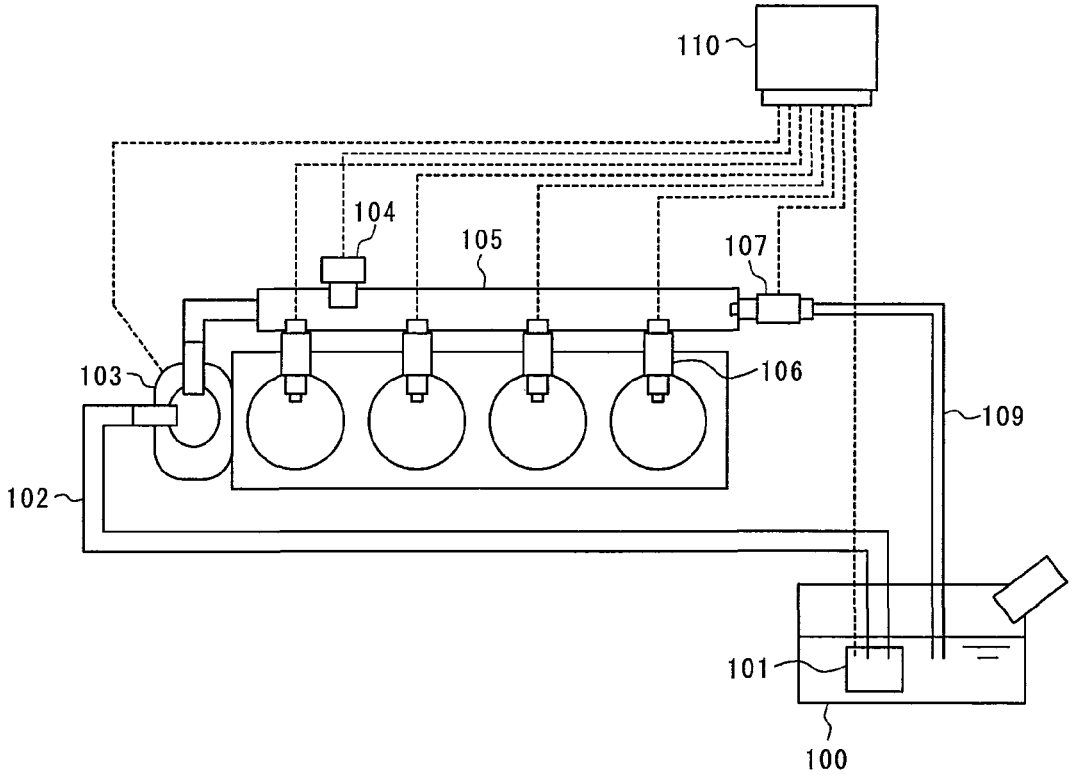
FIG. 12 is a diagram illustrating another configuration of a system in which a fuel injector for an internal combustion engine according to each embodiment of the present invention is applied to a direct injection gasoline engine fuel supply unit.

FIG. 12 is a diagram illustrating another configuration of a system in which a fuel injector for an internal combustion engine according to each embodiment of the present invention is applied to a direct injection gasoline engine fuel supply unit. Incidentally, reference numerals which are the same as those shown in FIG. 1 denote identical components.

In this example, fuel exhausted by a relief valve is returned to the fuel tank through a relief pipe 109, which is a point of difference from the system configuration shown in FIG. 1.

Also in this example, how to execute the pressure reduction control is the same as that described in the embodiments shown in FIGS. 2 through 11.

What is claimed is:

1. A fuel injector for an internal combustion engine, the fuel injector comprising:

a high pressure pump for pressure feeding high pressure fuel of the internal combustion engine;

a fuel rail for accumulating the fuel which is pressure fed by said high pressure pump;

an injection valve for injecting the fuel accumulated in said fuel rail into a cylinder;

pressure detection means for detecting the pressure of the fuel accumulated in said fuel rail;

target value calculation means for calculating a target value of the fuel pressure in said fuel rail;

an electromagnetic relief valve for discharging the pressure accumulated fuel in said fuel rail; and control means used for repeating opening and closing of the relief valve to relieve the fuel pressure in stages so that the fuel pressure in said fuel rail is decreased down to the target fuel pressure, wherein said control means changes a relief valve opening/closing time in a time series manner, and wherein said control means sets a relief valve opening time such that the opening time is long at first and gradually decreases thereafter.

2. A fuel injector for an internal combustion engine, the fuel injector comprising:

a high pressure pump for pressure feeding high pressure fuel of the internal combustion engine;

a fuel rail for accumulating the fuel which is pressure fed by said high pressure pump;

an injection valve for injecting the fuel accumulated in said fuel rail into a cylinder;

pressure detection means for detecting the pressure of the fuel accumulated in said fuel rail;

target value calculation means for calculating a target value of the fuel pressure in said fuel rail;

an electromagnetic relief valve for discharging the pressure accumulated fuel in said fuel rail; and control means used for repeating opening and closing of the relief valve to relieve the fuel pressure in stages so that the fuel pressure in said fuel rail is decreased down to the target fuel pressure, wherein said control means changes a relief valve opening/closing time in a time series manner, and wherein said control means sets a relief valve opening time such that the opening time is short at first and then is long before the opening time gradually decreases.

3. The fuel injector for the internal combustion engine according to claim 1, wherein every time the relief valve opens, said control means measures a deviation of the current fuel pressure from the target fuel pressure to change a next relief valve opening time.

4. The fuel injector for the internal combustion engine according to claim 3, wherein, when the difference between the current fuel pressure and the target fuel pressure is smaller than or equal to a specified value, said control means performs a control to stop the pressure reduction operation which is performed by the relief valve.

5. The fuel injector for the internal combustion engine according to claim 1, wherein, when the fuel pressure in said fuel rail becomes lower than or equal to the target fuel pressure during the pressure reduction operation which is performed by the relief valve, said control means performs a control to stop the pressure reduction operation which is performed by the relief valve.

6. The fuel injector for the internal combustion engine according to claim 1, wherein, after completion of the pressure reduction operation performed by the relief valve, said control means performs a control not to restart the pressure reduction operation which is performed by the relief valve, until the fuel pressure in said fuel rail becomes higher than or equal to a specified value.

7. The fuel injector for the internal combustion engine according to claim 1, wherein, after completion of the pressure reduction operation performed by the relief valve, said control means performs a control not to restart the pressure reduction operation which is performed by the relief valve, until a given period of time elapses.

8. The fuel injector for the internal combustion engine according to claim 1, wherein, while the pressure reduction operation is performed by the relief valve, said control means performs a control to stop the pressure feeding of fuel by the high pressure pump.

9. The fuel injector for the internal combustion engine according to claim 1, wherein, when the fuel pressure calculation means is out of order, said control means performs a control to stop the pressure reduction operation which is performed by the relief valve.

10. The fuel injector for the internal combustion engine according to claim 1, wherein, when the pressure feeding capability of the high pressure fuel pump decreases, said control means performs a control to stop the pressure reduction operation which is performed by the relief valve.

11. A fuel injector for an internal combustion engine, the fuel injector comprising:

a high pressure pump for pressure feeding high pressure fuel of the internal combustion engine;

a fuel rail for accumulating the fuel which is pressure fed by said high pressure pump;

an injection valve for injecting the fuel accumulated in said fuel rail into a cylinder;

pressure detection means for detecting the pressure of the fuel accumulated in said fuel rail;

target value calculation means for calculating a target fuel pressure of the fuel pressure in said fuel rail;

an electromagnetic relief valve for discharging the pressure accumulated fuel in said fuel rail; and control means used for repeating opening and closing of the relief valve to relieve the fuel pressure in stages so that the fuel pressure in said fuel rail is decreased down to the target fuel pressure;

wherein said control means changes a relief valve opening/closing time in a time series manner based on a deviation between actual fuel pressure detected by the pressure detection means and the target fuel pressure such that the actual fuel pressure becomes the target fuel pressure.

12. The fuel injector for the internal combustion engine according to claim 11, wherein every time the relief valve opens, said control means measures a deviation of the current fuel pressure from the target fuel pressure to change a next relief valve opening time.

13. The fuel injector for the internal combustion engine according to claim 12, wherein, when the difference between the current fuel pressure and the target fuel pressure is smaller than or equal to a specified value, said control means performs a control to stop the pressure reduction operation which is performed by the relief valve.

14. The fuel injector for the internal combustion engine according to claim 11, wherein, when the fuel pressure in said fuel rail becomes lower than or equal to the target fuel pressure during the pressure reduction operation which is performed by the relief valve, said control means performs a control to stop the pressure reduction operation which is performed by the relief valve.

15. The fuel injector for the internal combustion engine according to claim 11, wherein, after completion of the pressure reduction operation performed by the relief valve, said control means performs a control not to restart the pressure reduction operation which is performed by the relief valve, until the fuel pressure in said fuel rail becomes higher than or equal to a specified value.

16. The fuel injector for the internal combustion engine according to claim 11, wherein, after completion of the pressure reduction operation performed by the relief valve, said control means performs a control not to restart the pressure reduction operation which is performed by the relief valve, until a given period of time elapses.

17. The fuel injector for the internal combustion engine according to claim 11, wherein, while the pressure reduction operation is performed by the relief valve, said control means performs a control to stop the pressure feeding of fuel by the high pressure pump.

18. The fuel injector for the internal combustion engine according to claim 11, wherein, when the fuel pressure calculation means is out of order, said control means performs a control to stop the pressure reduction operation which is performed by the relief valve.

19. The fuel injector for the internal combustion engine according to claim 11, wherein, when the pressure feeding capability of the high pressure fuel pump decreases, said control means performs a control to stop the pressure reduction operation which is performed by the relief valve.

* * * * *